United States Patent [19]

Ryback

[11] Patent Number: 4,756,308

[45] Date of Patent: Jul. 12, 1988

[54] PROTECTIVE BREATHING MASK HAVING A SPEAKING DIAPHRAGM FOR CLOSE COMMUNICATION AND AN ELECTROACOUSTIC TRANSDUCER SYSTEM FOR INDIRECT SPEECH TRANSMISSION FROM INSIDE THE MASK

[75] Inventor: Helmut Ryback, Langenzersdorf, Austria

[73] Assignee: AKG Akustische u.Kino-Geräte Gesellschaft m.b.H., Austria

[21] Appl. No.: 790,323

[22] Filed: Oct. 23, 1985

[30] Foreign Application Priority Data

Oct. 25, 1984 [AT] Austria ..... A 3406/84

[51] Int. Cl.[4] ..... A62B 18/08

[52] U.S. Cl. ..... 128/201.19; 128/207.12

[58] Field of Search ..... 128/201.19, 207.12; 181/0.5, 18, 21, 126, 128, 144, 148, 157

[56] References Cited

U.S. PATENT DOCUMENTS

| | | | |
|---|---|---|---|
| 3,064,089 | 11/1962 | Ward | 128/201.19 |
| 3,124,130 | 3/1964 | Klinger | 128/201.19 |
| 3,140,754 | 7/1964 | Motsinger | 125/201.19 |
| 3,174,129 | 3/1965 | Laughlin et al. | 128/201.19 |
| 3,180,333 | 4/1965 | Lewis | 128/201.19 |
| 3,210,723 | 10/1965 | Martelli et al. | 128/201.19 |
| 3,218,607 | 11/1965 | Brock et al. | 128/201.19 |
| 4,071,110 | 1/1978 | Payne | 128/201.19 |
| 4,373,520 | 2/1983 | Arbique | 128/201.19 |
| 4,374,301 | 2/1983 | Frieder, Jr. | 179/1 R |

FOREIGN PATENT DOCUMENTS

| | | |
|---|---|---|
| 342129 | 10/1978 | Austria . |
| 3013939 | 10/1981 | Fed. Rep. of Germany . |
| 1215218 | 12/1970 | United Kingdom . |
| 2081550 | 12/1984 | United Kingdom . |

*Primary Examiner*—Edward M. Coven
*Assistant Examiner*—K. M. Reichle
*Attorney, Agent, or Firm*—McGlew & Tuttle

[57] ABSTRACT

A protective breathing mask, in addition to having a speaking diaphragm for close communication is equipped with an electroacoustic transducer system for indirect speech transmission from inside the mask. In order to achieve high transmission quality for human speech with a simple apparatus without the occurrence of interference noise, it is provided that the sound output channel is closed on the mask side by an auxiliary diaphragm which is acoustically coupled with the speaking diaphragm via a secondary air chamber, and is also mechanically connected directly or indirectly with a movable element of the electroacoustic transducer system.

1 Claim, 2 Drawing Sheets

1
2
3
4
5
6
7
8
9
10
11
12

PROTECTIVE BREATHING MASK HAVING A SPEAKING DIAPHRAGM FOR CLOSE COMMUNICATION AND AN ELECTROACOUSTIC TRANSDUCER SYSTEM FOR INDIRECT SPEECH TRANSMISSION FROM INSIDE THE MASK

FIELD AND BACKGROUND OF THE INVENTION

This invention relates, in general, to sound transmitting devices and, in particular, to a new and useful protective breathing mask which has both a speaking diaphragm for close communication and an electroacoustic transducer system for indirect speech transmission from inside the mask.

The invention relates particularly to a protective breathing mask which in addition to having a speaking diaphragm for close communication is also equipped with an electroacoustic transducer system for indirect speech transmission from inside the mask.

The prior art provides a number of methods of speech transmission for use with a protective breathing mask. A typical prior art system of this kind is described in German Unexamined Patent Disclosure (Offenlegungsschrift) No. 30 13 939, which relates to a microphone-loudspeaker to be used selectively with a protective breathing mask or safety helmet. The microphone-loudspeaker, consisting of an electroacoustic, preferably dynamic transducer, fits into a cup-shaped housing that is removably attached by its cylindrical rim to the rim head of the exhale valve housing of the breathing mask or to the chin protector of the safety helmet. The sole advantage of such a transducer system is that one and the same transducer can be used both as a microphone and as a loudspeaker. A microphone-loudspeaker, however, always suffers from disadvantage of reduced transmission quality for acoustic reasons. Another disadvantage is that the microphone can only pick up the sound spoken through the mask, which is considerably impaired in intelligibility. This makes it even more likely that sound will be picked up from the close vicinity of the person wearing the protective breathing mask, and what is primarily transmitted is interference sound containing no information, such as noise from the exhale valve.

In order to achieve a tolerably useful degree of speech intelligibility, the antechamber of the exhale valve must be designed as a Helmholtz resonator, with a resonance frequency of around 2,400 Hz, and another Helmholtz resonator with a resonance frequency of 3,000 Hz must be built into the microphone-loudspeaker itself in order to guarantee that the frequency range to be transmitted for radiophone communication is at least 3,000 Hz.

The low and unsatisfactory reproduction quality of microphone-loudspeakers is due to the fact that vibration conditions for the transducer diaphragm are different for sound reception than they are for sound reproduction, and electrical means are required to harmonize the frequency patterns of the two transducers. It should also be noted that a diaphragm diameter of 3 to 4 cm, such as is customary in such microphone-loudspeakers, is not adequate for the reproduction of the lower frequencies. The nonlinear distortion factor is also correspondingly high in any such small loudspeaker systems. It must be considered, therefore, whether unmistakeable speech intelligibility is assured in emergency use by a microphone-loudspeaker of the type described, since a misunderstanding could have fatal consequences.

In German Unexamined Patent Disclosure No. 30 13 939, various prior art devices for person-to-person communication are described. Thus, walkie-talkies, compact phone sets, necklace microphones, microphone systems to be carried on the cheekbone under the ear and microphone attached to the exhale valve of a protective breathing mask are proposed for use, all of which involve some sort of disadvantage. For instance, to operate the walkie-talkie device, the wearer must have one hand free, which in use considerably hinders the wearer in his freedom of movement. In another example, the arm of the phone set bearing the microphone must be swiveled around to the mouth area after the gas mask has been donned, and at that spot only a largely unintelligible speech signal spoken through the mask can be picked up. The other systems mentioned are mostly inadequate from an acoustical standpoint and are also uncomfortable to carry, or else the influence of interference sounds such as surrounding noise and valve noise from the protective breathing mask impairs the quality of the speech signal.

German Unexamined Patent Disclosure No. 31 37 113 does, it is true, mention a helmet/breathing mask arrangement that is equipped with a contact microphone, but means by that a microphone of the kind zlready described in German Unex. Patent Disclosure No. 30 13 939, which picks up speech vibrations directly at the head.

AT Patent No. 342,129 also discloses a gas or smoke mask that has a microphone in the cheek piece in the area near the mouth on the inside of the shell consititu-ing the gas mask that directly picks up the air sound waves created by speech. Since this mask is not equipped with a speaking diaphragm, even for close communication the built-in microphone must be used, which can sometimes come into direct contact with the cheek of the wearer of the gas mask, whereupon intelligibility is sharply reduced, quite apart from the disadvantageous position of the microphone to the side of the mouth, a position in which the higher frequencies, which contribute largely to perfect intelligibility, are greatly weakened.

German Unexamined Patent Disclosure No. 3 127 677 discloses a speaking device for mask wearers which entails at the minimum setting up a a transmission arrangement on the outside of the mask that is capable of producing an output signal corresponding to the voice of the mask wearer. The output signal can then be conveyed to a loudspeaker that the mask wearer is carrying on his person in order to produce sound signals that can be heard by persons in the vicinity of the mask wearer. It is clear that this prior art arrangement does not include a speaking diaphragm for close communication, but instead requires a complicated electroacoustic system in order to accomplish it. Furthermore, in the prior art arrangement the sound must penetrate the mask material, which does not make for clear intelligibility outside the mask of what is spoken. Moreover, the design expense is considerable and is all out of proportion to the results obtained.

Finally, in German Patent Publication (Auslegeschrift) No. 708 045, a mask connecting piece is described with at least one exhale valve and a speaking diaphragm. The latter is solely for close communication and involves an inner mask that both prevents the out-going breath from going directly to the view window and conducts speech sounds to the speaking diaphragm, so that the sound waves pass to the outside via an antechamber. Under this prior art arrangement, there is no possibility of transmitting over a distance what is spoken inside the mask.

SUMMARY OF THE INVENTION

According to the invention, therefore, in contrast to the prior art, sound transmission from a protective breathing mask is accomplished with simple means and with a high level of transmission quality for human speech without simultaneously transmitting the interference sound from around the mask wearer and/or valve and breathing noises from the mask itself. The aim of the invention is, in particular, to insure that, in contrast to prior art arrangements, the level differential between meaningful sound arising from speech and any interference noise is so great that interference as such is almost imperceptible.

The invention provides a breathing mask with a housing closing the sound output channel on the mask side with an auxiliary diaphragm that is coupled with the speaking diaphragm by a secondary air chamber and is also mechanically connected directly or indirectly with a movable element of the electroacoustic transducer system.

By an electroacoustic transducer system is meant the interacting elements of a transducer that embody the principle by which the transducer operates and which in themselves accomplish the conversion of sound or a movement into an electromotive force, or the reverse. As an example, an electrodynamic transducer system can consist merely of a magnet system and related coil. When such a transducer system is equipped with an element that moves the coil or the magnet, e.g., a diaphragm that picks up or puts out sound, the result is an electroacoustic transducer. Hereinafter, therefore, the term electroacoustic system shall refer only to an arrangement of two interacting transduction elements that move relative to one another. Piezoelectric transducer systems, however, constitute a special case, since in many cases they are capable of working as electroacoustic transducers even without a diaphragm or the like. Nevertheless, even a piezoelectric system must be movable in at least some part, otherwise conversion of, for example, sound pressure into an electromotive force or the reverse would not be possible.

The arrangement pursuant to the invention has the advantage that as a result of the acoustic coupling of the diaphragm of the protective breathing mask, the transmission quality and intelligibility of the transmitted human speech is extraordinary improved.

When words are spoken with the protective breathing mask on, because of restricted space between face and mask no radiation field can develop for low and middle frequencies, so that acoustic characteristics of a pressure chamber must be taken into account. The excess pressure produced inside the protective breathing mask by speech is many times higher than the measurable sound pressure in the near radiation field at an interval of about 5 cm in front of the mouth. In general, the excess sound pressure inside the mask will be approximately 30 dB higher than the pressure created in the near radiation field under the same conditions. The excess sound pressure inside the protective breathing mask sets all parts of the mask capable of vibrating, and particularly the speaking diaphragm, moving in analogous vibrations, which can be converted into analogous electrical signals by means of appropriate sound receivers, which, because of the high excess sound pressure prevailing inside the protective breathing mask makes for an extraordinarily good interference differential with respect to the noise originating in the vicinity of the person wearing the mask, so that the meaningful spoken sound is transmitted without interference.

The invention is particularly advantageous when the embodiment of the protective breathing mask does not permit direct coupling of the moving part of the electroacoustic transducer system with the speaking diaphragm of the mask. In such case, the use of the auxiliary diaphragm, which is connected with the speaking diaphragm acoustically via a secondary air chamber and is in turn coupled with the moving member of the electroacoustic transducer system, makes it possible to install the transducer in the mask in a manner adaptable to the given space conditions. In this arrangement, the acoustic rigidity of the air in the secondary air chamber must be very great in comparison to the flexibility of the two diaphragms, so that the speaking diaphragm stimulates the auxiliary diaphragm to move in a way that conforms as closely as possible to the movement of the speaking diaphragm.

The auxiliary diaphragm provided pursuant to the invention will best conform to the movement of the speaking diaphragm if pursuant to another feature of the invention the natural resonance and the logarithmic decrement of the two diaphragms are the same, or at least nearly the same. This insures the same vibration characteristics in each of the two diaphragms over a very broad range of frequencies.

A further advantageous refinement of the invention is to make the coupling between the movable member of the transducer system and the auxiliary diaphragm of the protective breathing mask detachable.

The capability of detaching such a transducer or transducer system from the protective breathing mask offers the advantage that the protective breathing mask can be used with or without it as needed, and when necessary the transducer can be attached quickly and easily to the protective breathing mask.

The speaking diaphragm installed in the protective breathing mask is positioned at an interval of around 4 cm in front of the mouth and nose of the wearer of the mask and should enable the user of the mask to be understood by persons in his vicinity. In the nature of things, the intelligibility of such speech is subject to severe limitations, not the least of which is the extremely poor sound radiation out of the speaking diaphragm itself. A great improvement in transmission quality resulting in complete speech intelligibility can only be achieved when, as the invention proposes, the speaking diaphragm and auxiliary diaphragm are utilized for sound reception by the electroacoustic transducer system, since the excess sound pressure inside the protective breathing mask is thereby converted into analogous electrical signals. These analogous electrical signal are transferred to an electronic communications system, such as a radio system or announcement system, and can be received in an earphone or headphone or from a loudspeaker. The advantage in contrast to prior art communications systems is first and foremost the nearly interference-free and undistorted and hence highly intelligible transmission.

Another useful refinement of the invention is that when the electroacoustic transducer system is expanded into a microphone by the addition of a diaphragm of its own, said diaphragm can be positioned directly onto the auxiliary diaphragm of the protective breathing mask. Such an arrangement is ideal for transmitting the vibrations of the speaking diaphragm of the protective breathing mask to the diaphragm of the microphone, if care is taken to insure that even at the largest possible amplitude of the speaking diaphragm the two diaphragms do not separate from one another. The advantage of this manner of coupling with the speaking diaphragm is that the microphone is positioned outside the protective mask and does not take up any space inside the mask. Using simple acoustic means such as acoustic friction, for example, the entire system consisting of speaking diaphragm and microphone can be harmonized at low cost in terms of vibration characteristics so that in a frequency range of approximately 50 Hz to 4,000 Hz, a linear, flat frequency response is achieved, which translates into a constant transmission factor in the same frequency range. Such a frequency response is more than adequate for clear speech intelligibility over an electronic communications sytem. Because of the occurrence of high speech-sound pressures of approximately 120 dB SPL inside the protective breathing mask, the microphone itself, in contrast to microphones conventionally used to date, must be very insensitive to avoid overloading in the electronic communications systems by the electrical signal given by the microphone. In other words, said microphone, when measured in a free radiation field, is highly insensitive and delivers at its electrical output end a voltage approximately 30 dB lower than any conventionally used dynamic microphone. This is also the reason for the big differential between noise level and the meaningful signal when speaking with the mask on. In general, the protective breathing mask itself when worn will have an additional dampening effect on noise in the surrounding environment. Noises that originate from the mask itself, such as exhale valve noises, are weakened by those 30 dB in any case and therefore become nearly inaudible in the course of transmission.

In another possible embodiment of the invention, the auxiliary diaphragm of the protective breathing mask is connected with at least one member of the magnet system of an electrodynamic transducer system, whose plunger coil or flat coil is fixed in position.

In such an arrangement, the auxiliary diaphragm of the protective breathing mask serves as a microphone diaphragm and is united with the other parts of the electrodynamic transducer system to form a microphone. This embodiment makes it unnecessary to equip the transducer system with its own microphone diaphragm and nevertheless constitutes a satisfactory and perfectly functioning dynamic microphone. This embodiment constitutes an inversion of the previously described embodiment of a dynamic microphone. It has the advantage that a dynamic microphone can be designed in conjunction with a protective breathing mask and attached to it in the easiest possible way.

Sound pick-up from the speaking diaphragm set vibrating may also be achieved, however, by establishing a rigid physical coupling between the auxiliary diaphragm of the protective breathing mask and a piezoelectric transducer. Piezoelectric transducers are particularly known for their light weight and small size.

Another possible method of sound reception can also be to have the auxiliary diaphragm of the protective breathing mask coupled with an element of an electrostatic transducer system. In the current state of the art in electret technology, electrostatic transducers can be produced in minature and are particularly appropriate for picking up vibrations from the auxiliary diaphragm because of their light weight, small size and simple electrical connection methods.

In accordance with the invention a protective breathing mask is equipped with a speaking diaphragm for close communication and includes an electroacoustic transducer system for indirect speech transmission from inside the mask. A high transmission quality for human speech is achieved with a simple arrangement without occurrence of interference noise. This is effected by insuring that a sound output channel is closed on the mask side by an auxiliary diaphragm which is acoustically coupled with a speaking diaphragm in a secondary air chamber and is it is also mechanically connected directly or indirectly with a movable element of the electroacoustic transducer system.

Accordingly, it is an object of the invention to provide an improved protective breathing mask which includes a mask body with a valve support housing which has an interior secondary air chamber, a sound output chamber in communication with the secondary chamber and extending outwardly of the mask body and with an electroacoustic transducer in the sound output chamber which has a movable element which is mechanically connected to a speaking diaphragm.

A further object of the invention is to provide a device for effecting speech through a protective mask which is simple in design, rugged in construction and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
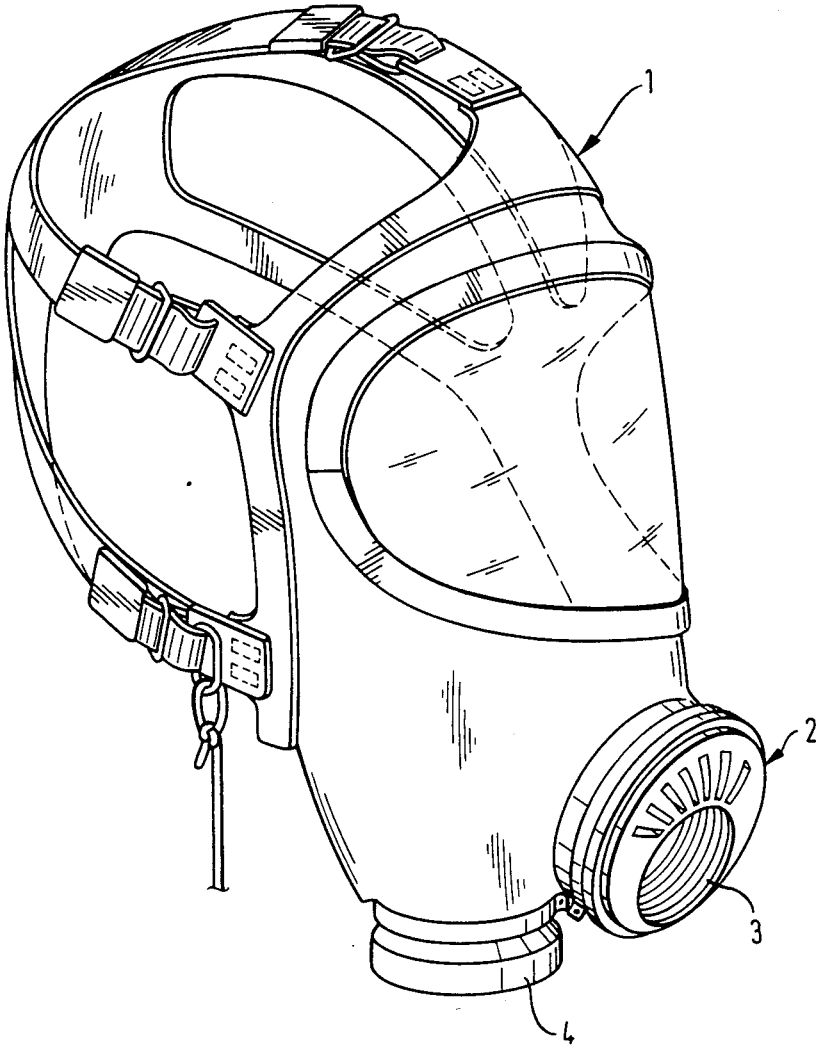
FIG. 1 is a perspective view of a typical protective breathing mask.

Referring to the drawings in particular, the invention embodied therein comprises a protective breathing mask which includes a mask body 1 which defines a breathing mask which fits over a wearer's face. The body 1 has a front portion with a tubular valve support 2. The valve support 2 has two axially extending chambers or channels including a sound outlet chamber or a channel 12 and a valve controlled air inlet channel or air channel 3. In accordance with the invention a speaking diaphragm 7 for close communication extends over the inner end of the channel 12 and the air channel 3 and it is associated with an electroacoustic transducer 11 and a system for direct speech transmission from the inside of the masked body to the exterior. In order to achieve a high transmission quality for human speech with simple means and without the currents of interference noise, it is provided that the sound output channel 12 is closed on the interior side of the masked body by an auxiliary diaphragm 9 which is acoustically coupled with a speaking diaphragm 7 which is positioned in an auxiliary air chamber which forms an extension of both of the channels 3 and 12. The auxiliary diaphragm 9 is also mechancially connected directly or indirectly with a moveable element 10 of the electroacoustic system 11.

FIG. 1 respresents a typical protective breathing mask comprising a rubber mask body 1 and two tubular valve supports 2 and 4. The speaking diaphragm, which is not shown, is positioned behind the air intake opening 3 in the valve support 2. The exhale valve is located in valve support 4.

Figure 2:
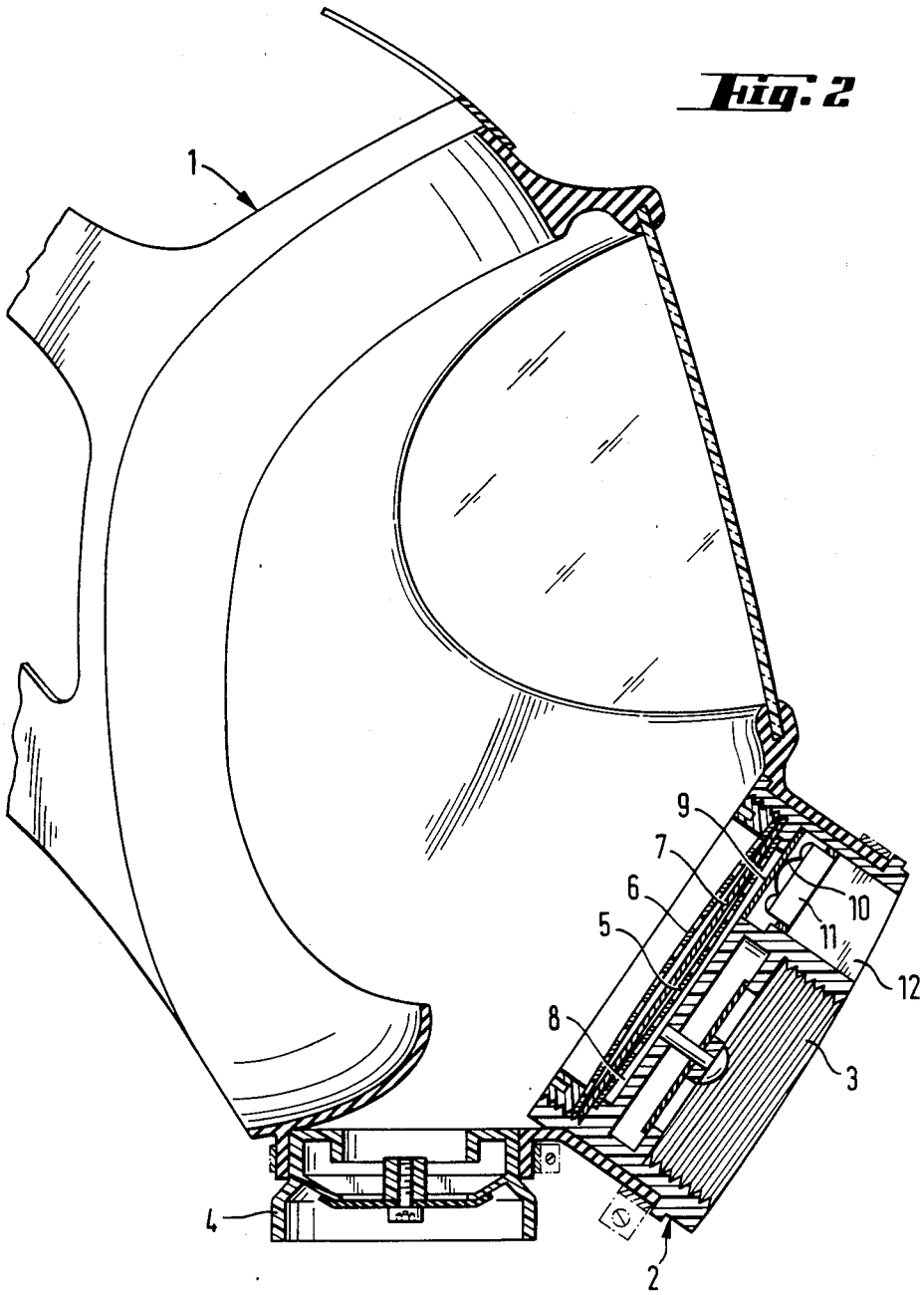
FIG. 2 is a sectional view of the same mask with the member made of plastic supporting the breathing valve and speaking diaphragm in accordance with the invention.

FIG. 2 shows a sectional view of the protective breathing mask 1 with the plastic support member 2 for the air intake valve and a speaking diaphragm 7. The speaking diaphragm 7 is protected against mechanical damage by means of protective filters 5 and 6 made of metal or plastic. When words are spoken, the speech sound pressure acting on speaking diaphragm 7 sets it vibrating and thereby causes sound vibrating and thereby causes sound vibrations in the air contained in the sound output channel 12. An auxiliary diaphragm 9 on the intake side of the sound outlet channel 12 that conducts the sound outward is mechanically connected with the moving member of the electroacoustic transducer system 11. The two diaphragms 7 and 9 are acoustically coupled via a secondary air chamber 8.

The movable member of the transducer system can either, as shown in FIG. 2, by way of example, be in contact with auxiliary diaphragm 9 through the moveable part 10 forming part of the electrodynamic transducer system 11, or a member of the magnet system may be directly connected with the auxiliary diaphragm 9, in which case the plunger coil or flat coil of the transducer system 11 is fixed in position.

The connection is each case between the auxiliary diaphragm 9 and the movable element of the transducer system 11 may be detachable or designed to be fixed, for example, by gluing.

While specific embodiments of the invention have been shown and described in detail to illustrate the application of the principles of the invention, it will be understood that the invention may be embodied otherwise without departing from such principles.

What is claimed is:

1. A protective breathing mask comprising a mask body defining a breathing mask and a first tubular valve support having two axially extending tubular channels extending from the exterior of said mask body toward the interior of said mask body, said first tubular valve support defining an auxiliary air channel extending into the interior of said mask and overlying and connecting with both of said two axially extending channels at their inner ends, one of said axially extending channels being an air inlet channel, the other of said axially extending channels comprising a sound outlet channel, a valve positioned within said air inlet channel for controlling the inlet of air into said air inlet channel, speaking diaphragm means for close communication extending over the inner end of said sound outlet channel and said auxiliary air channel, an electroacoustical transducer means for electro-acoustical indirect speech transmission from the interior of said mask acoustically coupled with said speaking diaphragm through said auxiliary air channel and being arranged in said sound output channel, said transducer means having movable means, and an auxiliary diaphragm covering the inner end of said sound outlet channel and mechanically coupled to said movable means.

* * * * *